United States Patent [19]

Edelman et al.

[11] Patent Number: 4,941,196

[45] Date of Patent: Jul. 10, 1990

[54] TAMPER EVIDENT BAG

[75] Inventors: Paul F. Edelman, Indianapolis; Cynthia M. Nulliner, Fairland, both of Ind.

[73] Assignee: Kcl Corporation, Shelbyville, Ind.

[21] Appl. No.: 265,583

[22] Filed: Nov. 1, 1988

[51] Int. Cl.[5] ..... B65D 27/30

[52] U.S. Cl. ..... 383/5; 383/78; 206/632; 206/807; 206/813

[58] Field of Search ..... 383/5, 78, 82, 83, 84, 383/85, 88, 89, 90, 91; 206/632, 813, 807

[56] References Cited

U.S. PATENT DOCUMENTS

| | | | |
|---|---|---|---|
| 1,201,519 | 10/1916 | Sorensen | 229/80 |
| 2,181,252 | 11/1939 | Vogel | 229/80 |
| 3,933,304 | 1/1976 | Judd | 383/5 |
| 4,180,929 | 1/1980 | Schultz, Jr. | 283/108 |
| 4,348,440 | 9/1982 | Kriozere | 383/78 X |
| 4,468,811 | 8/1984 | Shaw et al. | 383/5 |
| 4,483,018 | 11/1984 | Whelan | 383/5 |
| 4,566,627 | 1/1986 | Gendron | 229/81 |
| 4,709,396 | 11/1987 | Voshall et al. | 383/5 |
| 4,709,397 | 11/1987 | Voshall et al. | 383/5 |
| 4,712,729 | 12/1987 | Craig | 229/72 |
| 4,718,553 | 1/1988 | Adamoli et al. | 383/5 X |
| 4,759,643 | 7/1988 | Canno | 383/84 |
| 4,785,940 | 11/1988 | Wilson | 383/84 X |

FOREIGN PATENT DOCUMENTS

| | | | |
|---|---|---|---|
| 3342256 | 6/1983 | Fed. Rep. of Germany | 383/5 |
| 1536784 | 12/1978 | United Kingdom | 383/78 |
| 2051003 | 1/1981 | United Kingdom . | |
| 2149381 | 6/1985 | United Kingdom | 383/5 |
| 2167381 | 5/1986 | United Kingdom | 383/5 |

OTHER PUBLICATIONS

Pillar, Gerald F., *Protected Graphics Process Guide*, 3M Converter Specialties Divison, St. Paul, Minnesota 55144-1000.

"SecurMark TM 3381 Gloss White Label Stock", ScotchMark ® Product Information Sheet, Converter Specialties Division/3M, St. Paul Minnesota 55144-1000.

*Primary Examiner*—Stephen Marcus
*Assistant Examiner*—Jes F. Pascua
*Attorney, Agent, or Firm*—Woodard, Emgardt, Naughton, Moriarty & McNett

[57] ABSTRACT

A security bag includes a pair of overlapping wall panels joined at their bottom and side edges to define an opening at the top of the wall panels for carrying money and other items. One of the wall panels includes a receipt strip extending from the top of the panel and connected to the wall panel along a perforation line. The receipt strip and one of the wall panels each carry an identical identification number. The receipt strip is removable from the securty bag by severing along the perforation line. A closure flap is provided for closing the opening of the bag when the receipt strip is removed. The closure flap includes a strip of tape having an adhesive on one surface that is adhered at a lower attachment portion of the tape to one wall panel. A release liner covers the adhesive on an upper sealing portion of the tape and is readily removable to expose the adhesive for adhering the closure flap to the other wall panel to close the bag opening. The lower edge of the release liner is disposed below the perforation line so that the strip of tape does not adhere to the receipt strip, thereby preventing its removal from the security bag. The strip of tape includes a security pattern that is imperceptible when the bag is properly closed, but becomes visible on the wall panel and the closure flap when the flap is pulled from the wall panel. The security panel remains visible, even when the flap has been resealed over the opening to give a positive visible indication of tampering with the security bag.

7 Claims, 2 Drawing Sheets

TAMPER EVIDENT BAG

BACKGROUND OF THE INVENTION

This invention pertains to the field of security bags or pouches for carrying money or other valuable items. More particularly, the invention concerns a security bag having a tamper evident closure.

Businesses frequently transmit money or other valuables to other businesses and to banks. Often, these businesses will use a canvas deposit bag that is provided with a lock and key in order to secure the contents of the bag. In recent years, the canvas bag has been replaced with security pouches or bags composed of flexible plastic or polyester that exhibit the same strength characteristics as the canvas bags. Rather than a lock and key, these plastic bags use a number of adhesive strips mounted on a closure flap that is folded over the opening of the bag to close and seal the bag. The plastic bags of the prior art are tamper resistant in the event that the closure flap is pulled apart from the opening of the bag because the plastic bag material distorts and tears at the Portions where the adhesive attaches the flap onto the bag.

However, one difficulty with these plastic bags is that the closure flap can be readily and cleanly disengaged when subject to very cold temperatures. For instance, when the closure flap and adhesive is exposed to a Freon gas, the flap can be pulled away from the bag opening without leaving any evidence that the flap has been opened. Consequently, there is a need for a security bag or pouch that uses a closure flap that provides a permanent visible indication that the bag has been tampered with, even when the flap has been opened without distortion of the bag material.

SUMMARY OF THE INVENTION

In one embodiment of the invention, a security bag includes a pair of wall panels, each having a bottom, sides and a top, the wall panels being joined together at the bottoms and the sides of the panels and defining an opening at the tops. One of the wall panels includes an extension strip removably connected thereto at the top along a perforation line, the extension strip being removable therefrom by tearing along the perforation line. A closure flap for closing the opening is mounted to the one wall panel and includes a strip of tape having adhesive on one side of the tape. The strip of tape is connected at a lower portion of the strip by the adhesive to the one wall panel below the perforation line. A release liner covers the adhesive on an upper portion of the strip of tape and is readily removable therefrom. The release liner is positioned between the extension strip and the adhesive and between the perforation line and the adhesive on the strip of tape to prevent the strip of tape from attaching to the extension strip. When the extension strip is removed at the perforation line and when the release liner is removed from the upper portion of the strip of tape, the upper portion can be folded over the opening and attached by the adhesive to the other of the pair of wall panels to close the top of the bag.

In another aspect of the invention, at least the upper portion of the strip of tape includes a printed security pattern which is imperceptible when the opening is first closed. The printed security pattern becomes visible when the strip of tape is pulled away from the wall panel and the pattern remains visible even when the strip of tape is re-attached to the wall panel.

It is an object of the invention to provide a security bag having a removable extension strip and an adhesive strip closure flap to close the opening of the bag when the extension strip has been removed. It is a further object to provide an adhesive strip closure flap that is situated to prevent adherence of the strip to the removable extension strip.

Yet another object of the invention is to provide a tamper evident closure flap that provides a visible indication that the security bag has been opened and resealed, even when the bag is opened without distorting the bag material. Further objects and benefits of the invention will be found in the following written specification and accompanying figures.

DESCRIPTION OF THE PREFERRED EMBODIMENT

Figure 1:
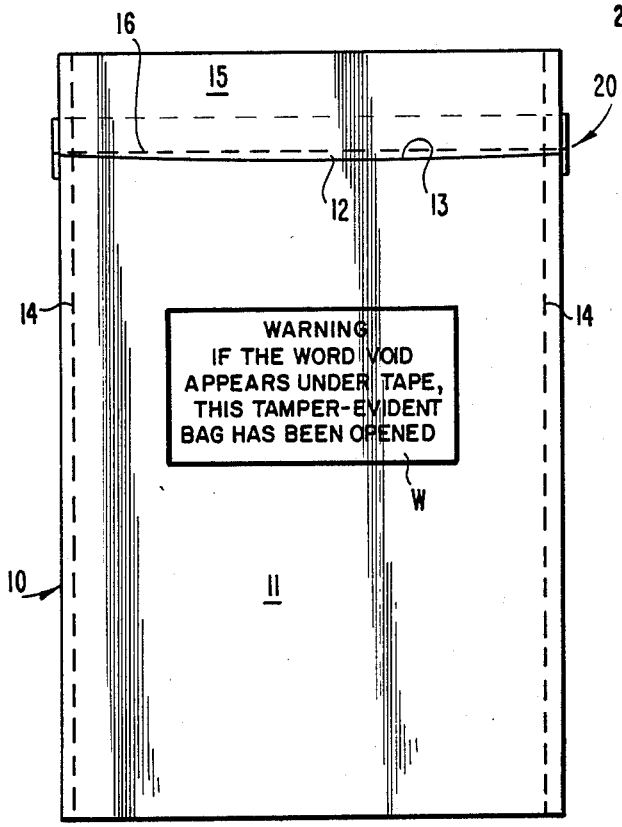
FIG. 1 is a back elevational view of the tamper evident bag of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
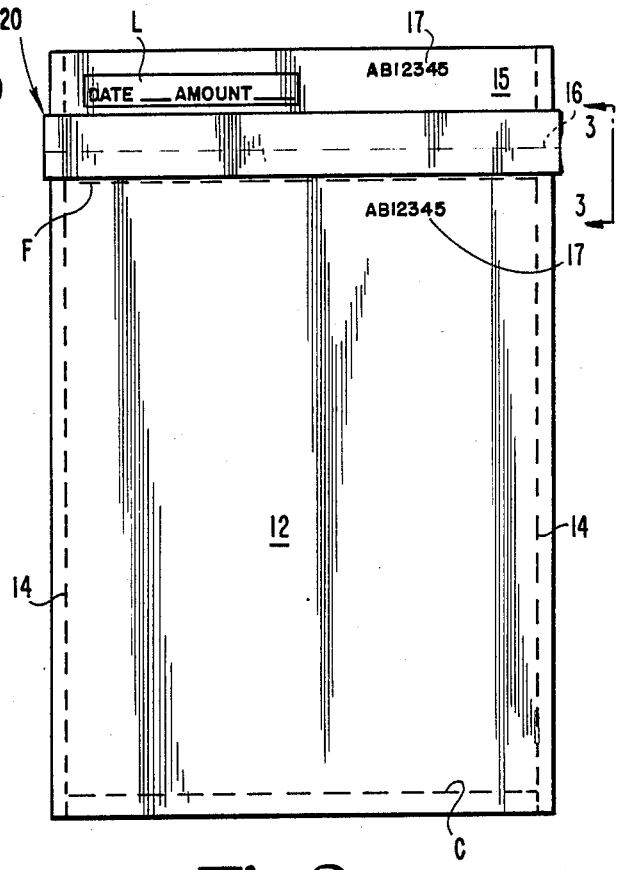
FIG. 2 is a front elevational view of the tamper evident bag of the present invention.

In a preferred embodiment of the present invention, a tamper evident bag or pouch 10 includes a first wall 11 and a second wall 12 that are sealed at the lateral edges of the walls along a seam 14. The first wall 11 and second wall 12 can be formed from a continuous strip of material that is folded to the configuration shown in FIGS. 1 and 2, and sealed at the edge seams 14 to form a pocket having an opening 13 at the top of the bag 10. The bag 10 thus configured is sufficient for carrying money or other valuable articles.

The first wall 11 is arranged to overlap only a portion of the second wall 12. The second wall 12 includes a receipt strip 15 that extends above the opening 13. The receipt strip 15 is removably connected as part of the second wall 12 along a perforation line 16, and is severable from the second wall 12 along the perforation line 16. A closure flap 20 is affixed to the second wall 12 on the surface of the second wall opposite the pocket opening 13.

On the outer surface of the second wall is an identification code 17 printed or embossed on the second wall below the perforation line 16 and on the removable receipt strip 15 above the perforation line. The tamper evident bag 10 can include other printed features, such as the warning label W on first wall 11 that might include a statement alerting the user of the tamper evident bag to the tamper indication provided by the present invention. On the reverse side of the bag, on the second wall 12, a fold line F can be printed to indicate where the closure flap 20 is folded over the opening 13 to close the tamper evident bag. A cut line C can also be printed at the bottom of the bag 10 to indicate the location along which the user can cut the bag open to remove the contents. The receipt strip 15 can include a label L upon which the date and contents of the deposit can be written.

Figure 3:
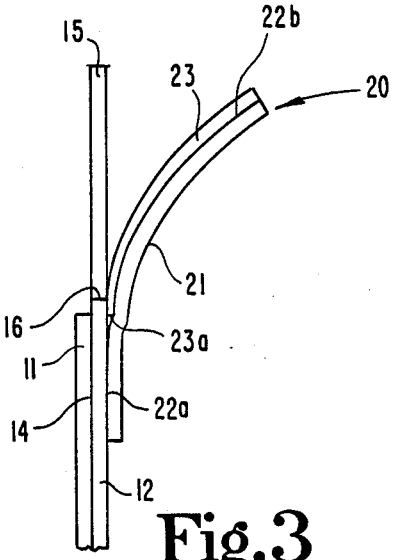
FIG. 3 is an enlarged side view of a portion of the tamper evident bag as viewed in FIG. 2 along the line 3—3 in the direction of the arrows, with the thickness of the elements of the bag being exaggerated for clarity.

The details of the closure flap 20 are illustrated with reference to FIGS. 3–5. The closure flap 20 includes a strip of tape 21. The strip of tape 21 includes an adhesive surface 22, having a lower attachment portion 22*a* adhered to the back of second wall 12, and an upper sealing portion 22*b* for sealing attachment to the front surface of the first wall 11 when it is desired to close the opening 13. A release liner 23 covers the sealing portion 22*b* until the tamper evident bag is to be closed.

In an important aspect of the present invention, the lower edge 23*a* of the release liner 23 is disposed at a pre-determined distance below the perforation line 16 on second wall 12. With the edge 23*a* of the release liner 23 located below the perforation line 16, the strip of tape 21 does not adhere to the removable receipt strip 15, thereby preventing its separation from the second wall along the perforation line. On the other hand, the edge 23*a* of the release liner 23 is sufficiently close to the perforation line 16 so that the release liner 23 can be pulled from the strip of tape 21 without restriction or binding against the second wall 12.

Figure 4:
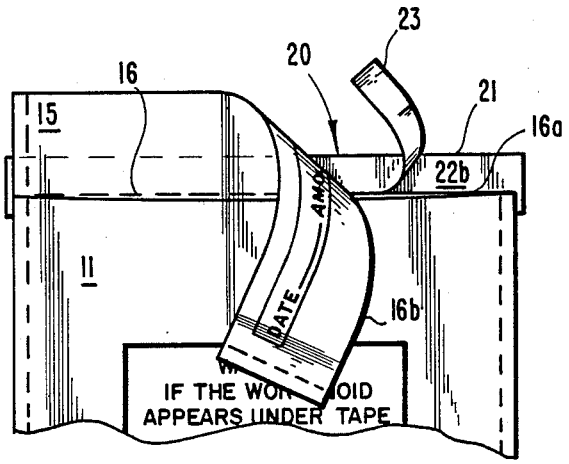
FIG. 4 is a back elevational view of the upper portion of the tamper evident bag as shown with the receipt strip partially removed at the perforation line and the release liner partially pulled away from the adhesive strip of the closure flap.
Figure 5:
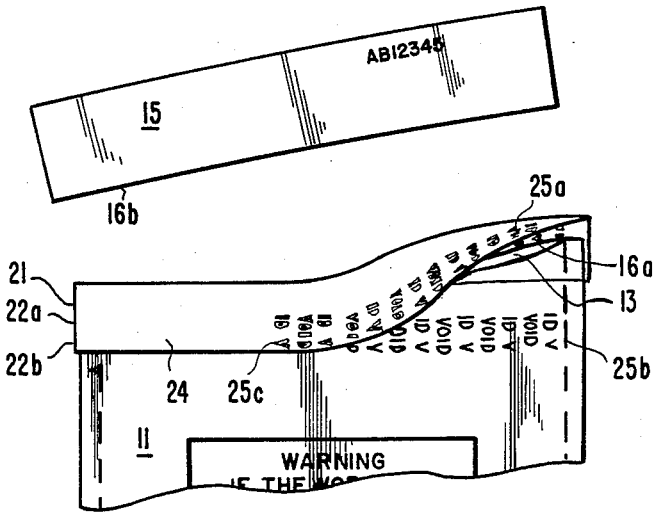
FIG. 5 is a top elevational view of the back of the tamper evident bag shown after the closure flap has been folded over the opening of the bag with a portion of the adhesive strip pulled away from the opening and another portion of the adhesive strip resealed over the opening, to display the security pattern on the tamper evident bag.

In using the tamper evident bag 10, the removable receipt strip 15 is first torn from the second wall 12 along the perforation line 16, leaving a severed edge 16*b* on the receipt and a severed edge 16a along top of the second wall 12, as illustrated in FIG. 4. The edge 23*a* of the release liner 23 is disposed slightly below the severed edge 16*a* of the second wall 12. With the receipt strip 15 removed, the release liner 23 is pulled from the strip of tape 21 to expose the adhesive of the sealing portion 22*b*. With the contents stored within the tamper evident bag 10, the closure flap 20 is folded over the pocket opening 13 along fold line F and the sealing portion 22*b* is pressed against the upper portion of the first wall 11.

Another important aspect of the tamper evident bag 10 of the present invention is described with reference to FIG. 5. When the strip of tape 21 is folded over and closes the pocket opening 13, a visual inspection of the closure indicates that the integrity of the seal has not been compromised when the adhesive strip is completely opaque, as shown in region 24 of the tape 21. However, when a portion of the strip of tape 21 has been pulled apart from the first wall 11 of the tamper evident bag, a security pattern 25*a* appears on the sealing portion 22*b* of the tape. Likewise, a security pattern 25*b* appears on the first wall 11. The security patterns 25*a* and 25*b* are mirror images of each other, with the security pattern 25*a* on the adhesive strip 21 appearing as a stencil image of the security pattern 25*b*. The security pattern is preferrably included on the lower attachment portion 22*a* of the tape to indicate if the attachment portion 22*a* has been pulled from the second wall 12.

In the preferred embodiment, the adhesive strip 21 is coated with an opaque adhesive material, such as a high strength acrylic adhesive. When the adhesive strip 21 is pulled from the first wall 11, some of this adhesive material remains adhered to the first wall 11. In order to accentuate that the seal of the tamper evident bag 10 has been broken, the opaque adhesive material remains on the first wall 11 in a specific security pattern, for instance a recurring pattern of the word "VOID". The adhesive material is likewise removed from the adhesive strip in the same recurring pattern to form the stencil image of the word "VOID" in security pattern 25*a*. If the bag is resealed, the security pattern 25*c* is visible through the adhesive strip 21. In the region 24, the adhesive material has not been separated from the sealing strip 21 and the security pattern does not appear.

In the preferred embodiment, the tamper evident bag 10 is composed of low density, thin-walled polyethylene that is strong, durable and well suited for heat sealing. Alternatively, the bag 10 can be composed of a similar flexible yet tough material such as Mylar. The closure flap 20 can be composed of a product marketed by the 3M Company under the trademark "SecurMark TM " 7381 Gloss White Label Stock. This product includes a 0.002 inch thick transparent polyester back having a printed white face stock with a destruct pattern or security pattern of a repeated array of the word "VOID". The adhesive is applied to the printed face in a 0.001 inch thick layer of #300 "Hi-Strength"0 Acrylic Adhesive. The manufacture and structure of a similar laminate adhesive strip is described in the patent to Schultz, Jr., U.S. Pat. No. 4,180,929, the specification of which is incorporated herein by reference.

In one manner of producing the tamper evident bag 10, the first wall 11 and second wall 12 are formed from a single sheet of polyethylene. The perforation line 16 is cut near one end of the second wall 12 and the first wall 11 is folded over onto the second wall 12 so that the top free edge of the first wall 11 is slightly below the perforation line 16. The edges of the first and second walls are heat sealed together and the bags are separated by using a guillotine cutter. A closure flap 20 can be composed of the SecurMark TM 7381 Stock of about 1 inch wide, with $\frac{3}{8}$ inch of the adhesive at the attachment portion 22*a* exposed and the remaining $\frac{5}{8}$ inch of adhesive at the sealing portion 22*b* covered by a release liner 23*a*. The exposed attachment portion 22*a* is affixed to the back of second wall 12 so that the lower edge 23*a* of the release liner 23 is slightly below the perforation line 16, which in the preferred embodiment is between 1/32 and 1/16 inch to ensure that the release liner does not bind between the tape and the second wall 12. The adhesive material used for the closure flap 20 is sufficiently strong and durable to allow the closure flap 20 to remain adhered to the back of the second wall 12 and the front of the first wall 11 when the tamper evident bag 10 is closed.

The sealing flap 20, and particularly the adhesive strip 21, extends beyond the lateral edges of the bag, as best shown in FIG. 4. Specifically, the adhesive strip 21 overlaps the seam 14 along the sealed side edges of the first and second walls. Thus, if the bag is cut along one of the seams 14 and then resealed, the cut edge of the flap 20 and strip 2l would no longer extend beyond the edge of the bag as originally produced, thereby giving an immediate visual indication that the bag has been disturbed.

One benefit of the security pattern on the closure flap 20 is that a user can positively determine whether the tamper evident bag 10 has been opened and resealed. Even when the closed closure flap 20 has been exposed to a Freon spray, the closure flap can be opened without distorting the adhesive strip 21, but the security patterns 25*a –c* still appear on the tamper evident bag 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A security bag comprising:

a pair of wall panels, each having a bottom, sides and a top, said wall panels being joined together at said bottoms and said sides and defining an opening at said tops;

one of said wall panels having an extension strip removably connected thereto at said top along a perforation line, said extension strip being removable therefrom by tearing along said perforation line;

a closure flap for closing said opening, said closure flap including;

a strip of tape having adhesive on one side of said strip of tape, said strip of tape being connected at a lower portion of said strip of tape by the adhesive to said one of said wall panels below said perforation line; and a release liner covering the adhesive on an upper portion of said strip of tape and readily removable therefrom, said release liner positioned between said extension strip and the adhesive and said release liner further positioned between said perforation line and the adhesive on said strip of tape to prevent said strip of tape from attaching to said extension strip;

whereby, when said extension strip is removed at said perforation line and when said release liner is removed from said upper portion of said strip of tape, said upper portion can be folded over said opening and attached by the adhesive to the other of said pair of wall panels to close said opening.

2. The security bag of claim 1, wherein:

at least said upper portion of said strip of tape includes a printed security pattern which is imperceptible when said opening is first closed and which becomes visible when said strip of tape is pulled away from said other of said pair of wall panels, said printed security pattern remaining visible even when said strip of tape is re-attached to the wall panel.

3. The security bag of claim 1, wherein said release liner includes a lower edge and said release liner is positioned on said strip of tape so that said lower edge extends a pre-determined distance below said perforation line on said one of said wall panels, said distance being sufficiently small to prevent said release liner from binding between the strip of tape and the one of said wall panels when the release liner is to be removed from the strip of tape.

4. The tamper evident bag of claim 1 wherein at least said upper portion of said strip of tape includes tamper indicating means for indicating when the bag has been opened and resealed, whereby when said upper portion is pulled from the wall panel a printed security pattern becomes visible, said printed security pattern remaining visible even when said second portion is re-attached to the wall panel.

5. The tamper evident bag of claim 4, wherein said tamper indicating means includes an opaque adhesive coating having a first adherent region including said printed security pattern and a second adherent region outside said printed security pattern, said second adherent region having greater adherent properties than said first adherent region.

6. The tamper evident bag of claim 5 wherein:

said opaque adhesive coating is composed of a cold temperature resistant adhesive material.

7. The tamper evident bag of claim 4 wherein:

said closure flap includes a portion of said flap extending beyond said sides of said wall panels.

* * * * *

UNITED STATES PATENT AND TRADEMARK OFFICE

CERTIFICATE OF CORRECTION

PATENT NO. : 4,941,196

DATED : July 10, 1990

INVENTOR(S) : Paul F. Edelman, et al.

It is certified that error appears in the above-identified patent and that said Letters Patent is hereby corrected as shown below:

In block 73 of the title page, change the assignee's name "KcL Corporation" to --KCL Corporation--.

In block 56 of the title page, please change attorney, agent, or firm from "Woodard, Emgardt, Naughton, Moriarty & McNett" to --Woodard, Emhardt, Naughton, Moriarty & McNett--.

In column 1, line 24, please change "Portions" to --portions--.

Signed and Sealed this

Thirteenth Day of August, 1991

*Attest:*

HARRY F. MANBECK, JR.

*Attesting Officer*

*Commissioner of Patents and Trademarks*